US008341787B2

(12) United States Patent
Kim et al.

(10) Patent No.: US 8,341,787 B2
(45) Date of Patent: Jan. 1, 2013

(54) DRUM TYPE WASHING MACHINE HAVING BALL BALANCERS AND CONTROLLING METHOD OF THE SAME

(75) Inventors: Hyun Bae Kim, Yongin-si (KR); Sung Mo Lee, Gunpo-si (KR); Kyo Soon Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 355 days.

(21) Appl. No.: 12/232,819

(22) Filed: Sep. 24, 2008

(65) Prior Publication Data

US 2009/0183318 A1 Jul. 23, 2009

(30) Foreign Application Priority Data

Jan. 22, 2008 (KR) ..... 10-2008-0006469

(51) Int. Cl.
*D06F 39/00* (2006.01)

(52) U.S. Cl. ..... 8/159; 8/158; 68/3 R

(58) Field of Classification Search ..... None
See application file for complete search history.

(56) References Cited

U.S. PATENT DOCUMENTS 5,862,553 A * 1/1999 Haberl et al. ..... 8/159
5,970,555 A * 10/1999 Baek et al. ..... 8/159
2005/0081308 A1* 4/2005 Kim et al. ..... 8/158
2006/0000243 A1* 1/2006 Lee ..... 68/12.06
2006/0179584 A1* 8/2006 Choi et al. ..... 8/158

FOREIGN PATENT DOCUMENTS

EP 1 096 050 A2 5/2001
EP 1 533 411 A2 5/2005
EP 1 950 336 A1 7/2008
KR 10-2007-0015682 2/2004
KR 10-2007-0081876 8/2007

* cited by examiner

*Primary Examiner* — Michael Barr
*Assistant Examiner* — Jason Ko
(74) *Attorney, Agent, or Firm* — Staas & Halsey LLP

(57) ABSTRACT

Disclosed herein are a drum type washing machine having ball balancers and a controlling method of the same that are capable of reducing spin-drying time. The drum type washing machine having ball balancers according to the present invention includes a rotary tub having the ball balancers mounted therein, a wash motor to rotate the rotary tub, and a controller to detect the eccentricity amount of the rotary tub while controlling the rotary tub to be rotated at a first rotation speed, and, when the rotation speed of the rotary tub reaches a second rotation speed, to control the rotary tub, such that the rotary tub is decelerated to a third rotation speed and a drainage process is carried out.

11 Claims, 6 Drawing Sheets

DRUM TYPE WASHING MACHINE HAVING BALL BALANCERS AND CONTROLLING METHOD OF THE SAME

CROSS-REFERENCE TO RELATED APPLICATION

This application claims the benefit of Korean Patent Application No. 2008-6469, filed on Jan. 22, 2008 in the Korean Intellectual Property Office, the disclosure of which is incorporated herein by reference.

BACKGROUND OF THE INVENTION

1. Field of the Invention

The present invention relates to a washing machine, and, more particularly, to a drum type washing machine having ball balancers and a controlling method of the same that are capable of reducing spin-drying time.

2. Description of the Related Art

Generally, a washing machine is an electric home appliance, including a water tub to store water (wash water or rinse water), a wash tub rotatably mounted in the water tub to receive laundry, and a wash motor to generate a drive force necessary to rotate the wash tub, to lift the laundry in the wash tub along the inner wall of the wash tub and drop the lifted laundry, during the rotation of the wash tub, thereby washing the laundry.

In recent years, there has been a drum type washing machine constructed in a structure in which a drum is mounted in a machine body such that a rotary shaft of the drum is parallel to the bottom of the machine body, and laundry is lifted and dropped, during the rotation of the drum, such that the laundry collides with wash water, and therefore, the laundry is washed. The drum type washing machine washes laundry such that the laundry is less damaged than other washing machines, with the result that the drum type washing machine is becoming popular among users.

In such a drum type washing machine, however, the rotary tub, in which the laundry is placed, is horizontally disposed, with the result that the rotary tub is rotated at high speed, while laundry is collected on the bottom of the rotary tub due to gravity, during a spin-drying operation. Consequently, the center of gravity of the laundry does not coincide with the center of rotation of the rotary tub, with the result that there is a great possibility of vibration and noise. To solve the problem, the conventional drum type washing machine includes ball balancers mounted in the rotary tub to maintain the dynamic balance of the rotary tub.

When the drum type washing machine having the ball balancers performs a spin-drying process using a centrifugal force generated by the high-speed rotation of the rotary tub, the rotary tub is vibrated to induce noise in an unbalanced state in which laundry placed in the rotary tub makes a lump at one side. For this reason, it is preferred to perform a spin-drying operation in a balanced state in which the laundry is uniformly distributed in the rotary tub.

To perform the spin-drying operation in the balanced state, the conventional drum type washing machine having ball balancers is operated to rotate the rotary tub to an eccentricity detection rotation speed, detect the eccentricity amount of the rotary tub while rotating the rotary tub at a constant speed, when the detected eccentricity amount is less than an allowable eccentricity amount, accelerate the rotary tub to a ball balancer position estimate speed, estimate the positions of the ball balancers while rotating the rotary tub at a constant speed, decide a point of time for spin-drying acceleration using the estimated positions of the ball balancers, and spin-drying accelerate the rotary tub at the decided point of time for spin-drying acceleration.

In the conventional drum type washing machine having ball balancers as described above, however, the rotary tub is rotated at a constant speed for a predetermined period of time to estimate the positions of the ball balancers, and then the rotary tub is spin-drying accelerated. As a result, water rising along the outside of the rotary tub by the rotating force of the rotary tub during the constant-speed rotation of the rotary tub continue to rise along the outside of the rotary tub even during the spin-drying acceleration of the rotary tub. The water rising along the outside of the rotary tub is drained later out of the water tub, with the result that spin-drying time increases.

Also, in the conventional drum type washing machine having ball balancers as described above, the rotary tub is accelerated to the predetermined speed, and the generation of vibration from the rotary tub is detected using the rotation speeds of the rotary tub before and after the acceleration. As a result, the generation of vibration from the rotary tub is not detected when the rotary tub is not accelerated.

SUMMARY OF THE INVENTION

Therefore, it is an aspect of the invention to provide a drum type washing machine having ball balancers and a controlling method of the same that are capable of reducing spin-drying time.

It is another aspect of the invention to provide a drum type washing machine having ball balancers and a controlling method of the same that are capable of detecting the generation of vibration from a rotary tub even when the rotary tub is not accelerated.

In accordance with one aspect, the present invention provides a drum type washing machine having ball balancers, including a rotary tub having the ball balancers mounted therein, a wash motor to rotate the rotary tub, and a controller to detect the eccentricity amount of the rotary tub while controlling the rotary tub to be rotated at a first rotation speed, and, when the rotation speed of the rotary tub reaches a second rotation speed, to control the rotary tub, such that the rotary tub is decelerated to a third rotation speed and a drainage process is carried out.

Preferably, the second rotation speed is less than a resonance range rotation speed of the rotary tub.

Preferably, the controller controls the rotary tub such that the rotary tub is accelerated to a spin-drying acceleration rotation speed after the rotation speed of the rotary tub is decreased to the third rotation speed, and the third rotation speed is a speed at which the positions of the ball balancers are not suddenly changed when the rotary tub is accelerated to the spin-drying acceleration rotation speed.

Preferably, the drum type washing machine further includes a wash motor drive unit having a command voltage generator, and the controller detects vibration from the rotary tub using a command voltage generated by the command voltage generator. The controller calculates the sum of preceding zone command voltages, generated at a plurality of points of time in a preceding zone, and the sum of succeeding zone command voltages, generated at a plurality of points of time in a succeeding zone, to calculate the difference between the sum of preceding zone command voltages and the sum of succeeding zone command voltages, and, when the calculated difference between the sum of preceding zone command voltages and the sum of succeeding zone command voltages is not less than an allowable difference between the sum of preceding zone command voltages and the sum of succeeding zone command voltages, detects that vibration from the rotary tub has been generated.

In accordance with another aspect, the present invention provides a controlling method of a drum type washing machine having ball balancers, including determining whether a spin-drying operation entry condition is satisfied, when the spin-drying operation entry condition is satisfied, accelerating a rotary tub having the ball balancers mounted therein to a first rotation speed to detect the eccentricity amount of the rotary tub, and, when the detected eccentricity amount is less than an allowable eccentricity amount, accelerating the rotary tub to a second rotation speed and decelerating the rotary tub to a third rotation speed.

Preferably, the second rotation speed is less than a resonance range rotation speed of the rotary tub.

Preferably, the controlling method further includes spin-drying accelerating the rotary tub after decelerating the rotary tub to the third rotation speed, and the third rotation speed is a speed at which the positions of the ball balancers are not suddenly changed when the rotary tub is spin-drying accelerated.

Preferably, the controlling method further includes, when the spin-drying operation entry condition is satisfied, detecting that vibration from the rotary tub has been generated using a command voltage generated by a wash motor drive unit to drive the rotary tub. The step of detecting that vibration from the rotary tub has been generated includes calculating the sum of preceding zone command voltages, generated at a plurality of points of time in a preceding zone, and the sum of succeeding zone command voltages, generated at a plurality of points of time in a succeeding zone, to calculate the difference between the sum of preceding zone command voltages and the sum of succeeding zone command voltages, and, when the calculated difference between the sum of preceding zone command voltages and the sum of succeeding zone command voltages is not less than an allowable difference between the sum of preceding zone command voltages and the sum of succeeding zone command voltages, detecting that vibration from the rotary tub has been generated.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
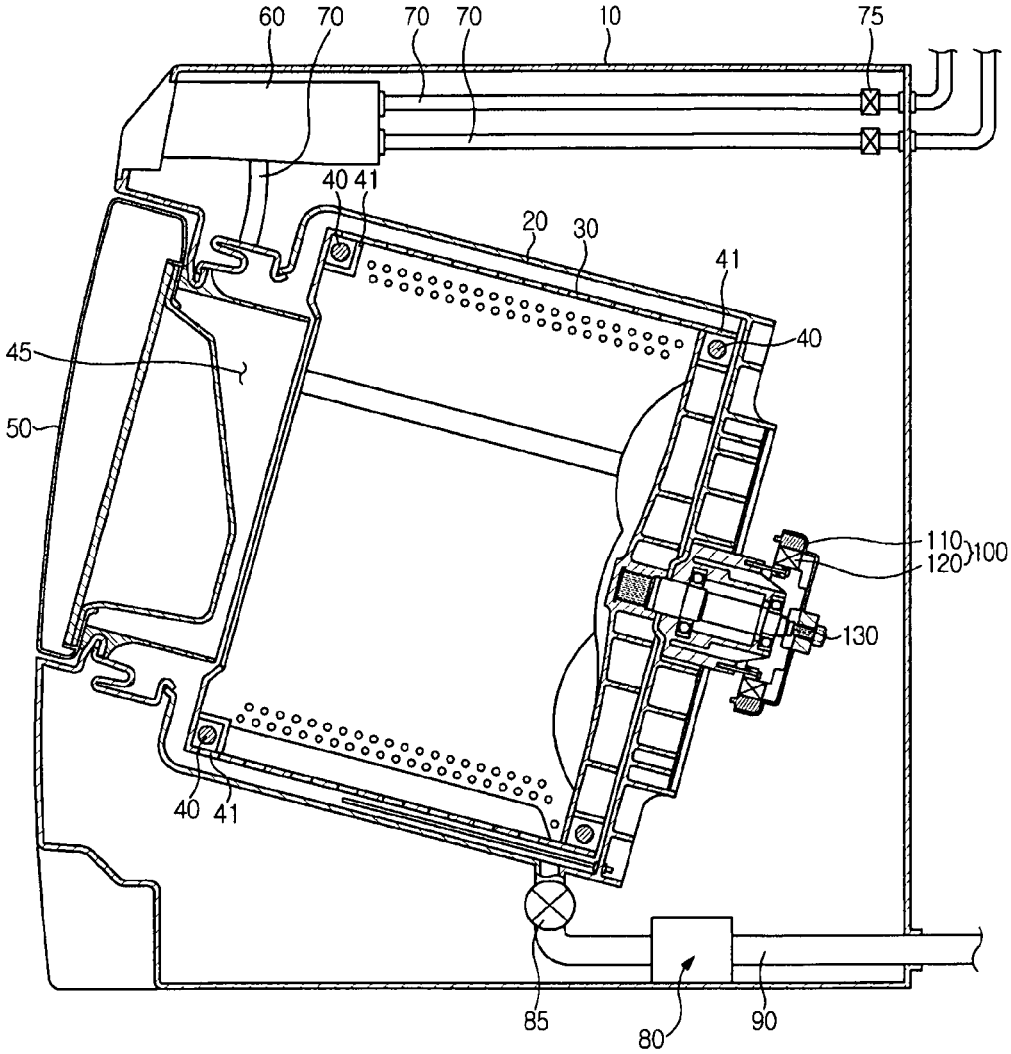
FIG. 1 is a side sectional view illustrating a drum type washing machine having ball balancers according to the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

Figure 2:
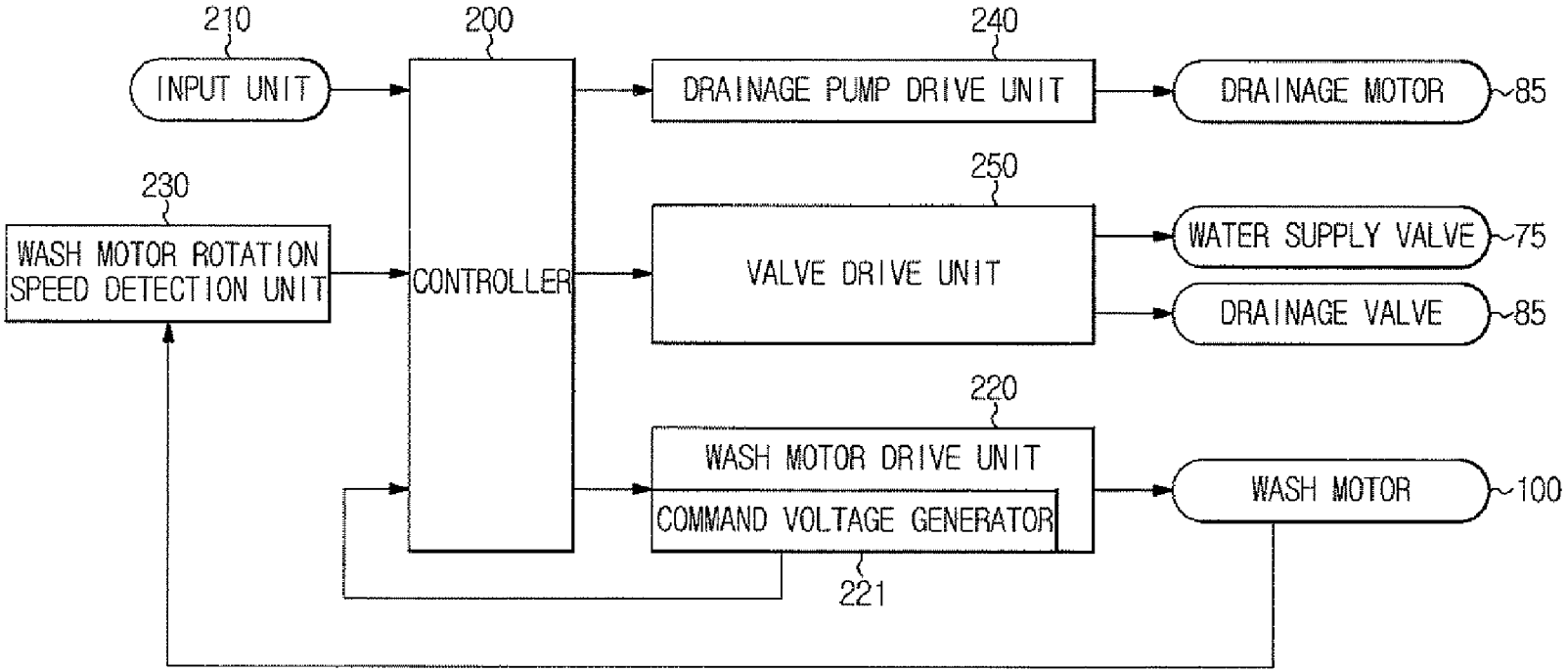
FIG. 2 is a block diagram illustrating a control system of the drum type washing machine having ball balancers according to the present invention.

Referring to FIGS. 1 and 2, a drum type washing machine 1 having ball balancers according to the present invention (hereinafter referred to as a 'drum type washing machine') includes a machine body 10 forming the external appearance of the drum type washing machine, a water tub 20 mounted in the machine body 10 to receive wash water or rinse water, the water tub 20 being open at the front thereof, a rotary tub 30 rotatably mounted in the water tub 20, the rotary tub 30 being open at the front thereof, a door 50 to open and close an opening 45 of the water tub 20 in front of the water tub 20, a wash motor 100 mounted at the rear of the water tub 20 to rotate a rotary shaft 130 connected to the rotary tub 30 and thus rotate the rotary tub 30, a water supply pipe 70 defining a flow channel along which wash water or rinse water is supplied from the outside of the machine body 10 to the water tub 20, a water supply valve 75 mounted on the water supply pipe 70 to open and close the water supply pipe 70 under the control of a controller 200, which will be described below, a detergent supply unit 60 mounted in the water supply pipe 70 to supply detergent or rinse to the water tub 20, a drainage pipe 90 connected to the lower end of the water tub 20 to define a flow channel along which wash water or rinse water, stored in the water tub 20, is drained outside the machine body 10, a drainage pump 80, having a drainage motor 85*a*, mounted on the drainage pipe 90 to drain wash water or rinse water from the water tub 20 outside the machine body 10, and a drainage valve 85 to open and close the drainage pipe 90 under the control of the controller 200, and the controller 200 to control the overall operation of the drum type washing machine 1.

At the front edge and the rear edge of the rotary tub 30 are formed ball balancer receiving parts 41 along which ball balancers 40 are movable. The ball balancers 40 serves to balance the rotary tub 30 during the rotation of the rotary tub 30.

The wash motor 100 includes a rotor 120 connected to the rotary shaft 130 and a stator 110 to provide a rotary magnetic field to the rotor 120 such that the rotor 120 can be rotated. The wash motor 100 rotates the rotary tub 30, and the rotation speed of the rotary tub 30 is controlled by the controller 200.

At the input side of the controller 200 are provided an input unit 210 to allow a user to input a control command to the controller 200 and a wash motor rotation speed detection unit 230 to detect the rotation speed of the wash motor 100. At the output side of the controller 200 are provided a wash motor drive unit 220 to drive the wash motor 100, a drainage pump drive unit 240 to drive the drainage motor 85*a*, and a valve drive unit 250 to drive the water supply valve 75 and the drainage valve 85.

The input unit 210 provides a washing course selected by the user to the controller 200.

The wash motor rotation speed detection unit 230 detects and provides the rotation speed of the wash motor 100 to the controller 200.

The wash motor drive unit 220 is realized by a general motor drive device. The wash motor drive unit 220 includes a command voltage generator 221. The command voltage generator 221 provides a command voltage reflecting the torque of the wash motor 100 to the controller 200.

Meanwhile, the controller 200 supplies a control signal to the wash motor drive unit 220, such that the rotary tub 30 is accelerated to a first rotation speed (eccentricity detection rotation speed), to detect the eccentricity amount of the rotary tub 30. When the detected eccentricity amount is less than an allowable eccentricity amount, the controller 200 controls the rotary tub 30 to be accelerated to a second rotation speed (drainage limit rotation speed). When the rotation speed of the rotary tub 30 reaches the second rotation speed (drainage limit rotation speed), the controller 200 controls the rotary tub 30 to be decelerated to a third rotation speed (ball balancer position estimate speed). Here, the second rotation speed (drainage limit rotation speed) is set to be less than a resonance range rotation speed of the rotary tub 30.

After the controller 200 controls the rotary tub 30 to reach the third rotation speed (ball balancer position estimate speed), the controller 200 estimates the positions of the ball balancers 40 and decides a point of time for spin-drying acceleration of the rotary tub 30 using the estimated positions of the ball balancers 40. Subsequently, the controller 200 controls the rotary tub 30 to be spin-drying accelerated at the point of time for spin-drying acceleration. At this time, the third rotation speed (ball balancer position estimate speed) is set to be a rotation speed at which the positions of the ball balancers 40 are not suddenly changed when the rotary tub 30 is spin-drying accelerated.

When the rotary tub 30 is rotated, the controller 200 substitutes command voltages V1 to Vn and Vn+1 to Vn+n generated from the command voltage generator 221 at a plurality of points of time to Mathematical equation 1 below to acquire the difference between the sum of preceding zone command voltages and the sum of succeeding zone command voltages. When the difference between the sum of preceding zone command voltages and the sum of succeeding zone command voltages is not less than an allowable difference between the sum of preceding zone command voltages and the sum of succeeding zone command voltages, the controller 200 detects that vibration from the rotary tub 30 has been generated.

$$Vdiff=[V1+V2+\ldots+Vn]-[Vn+1+Vn+2+\ldots+Vn+n] \quad \text{[Mathematical equation 1]}$$

Figure 3:
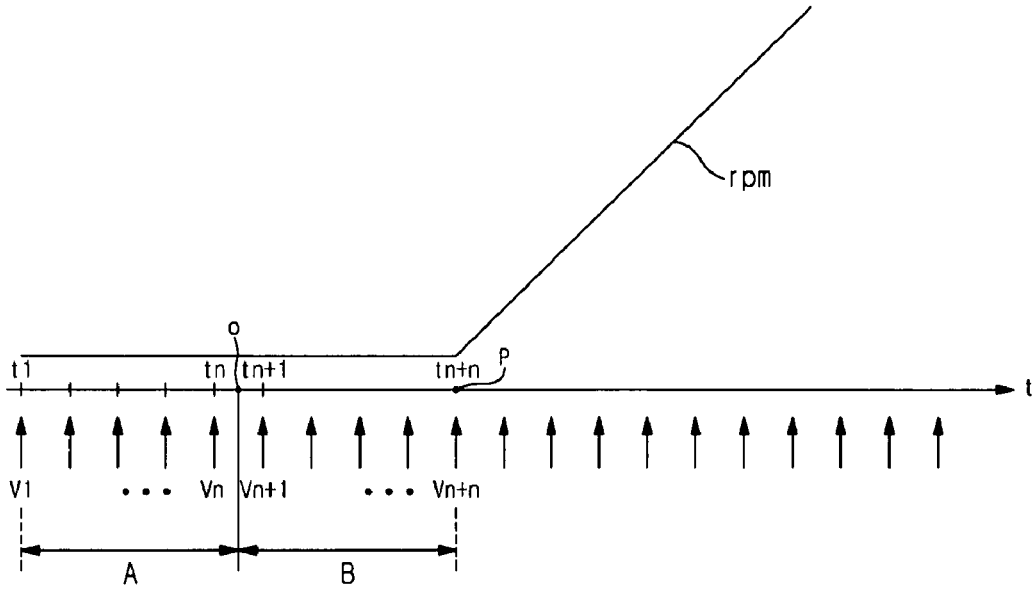
FIG. 3 is a view illustrating the detection of vibration from the drum type washing machine having ball balancers according to the present invention.

Where, Vdiff is the difference between the sum of preceding zone command voltages and the sum of succeeding zone command voltages, V1+V2+ . . . +Vn is the sum of command voltages V1, V2 . . . Vn inputted from the command voltage generator 221 at n points of past time having predetermined time intervals in the preceding zone A from the present time P, as shown in FIG. 3, during the rotation of the wash motor 100, and Vn+1+Vn+2+ . . . +Vn+n is the sum of command voltages Vn+1, Vn+2 . . . Vn+n inputted from the command voltage generator 221 at n points of past time having predetermined time intervals in the succeeding zone B from the present time P, as shown in FIG. 3, during the rotation of the wash motor 100. Here, the succeeding zone is a zone from 2 seconds ago to the present time P, and the preceding zone is a zone between 4 seconds ago to 2 seconds ago from the present time P.

In describing the ground for the method of detecting the generation of vibration from the rotary tub 30, when the rotary tub 30 is vibrated, a frictional force of the rotary tub 30 is changed according to the vibration from the rotary shaft 30. As a result, the load of the washing motor 100 is changed in proportion to the frictional force of the rotary shaft 130. And the command voltage generated from the command voltage generator 221 of the wash motor drive unit 220 is proportional to the load applied to the wash motor 100. Consequently, the difference between the sum of preceding zone command voltages and the sum of succeeding zone command voltages calculated by Mathematical equation 1 above means the fluctuation of load applied to the wash motor 100 and reflects the vibration from the rotary tub 30.

Hereinafter, a controlling method of the drum type washing machine having ball balancers according to the present invention will be described with reference to the accompanying drawings.

Figure 4:
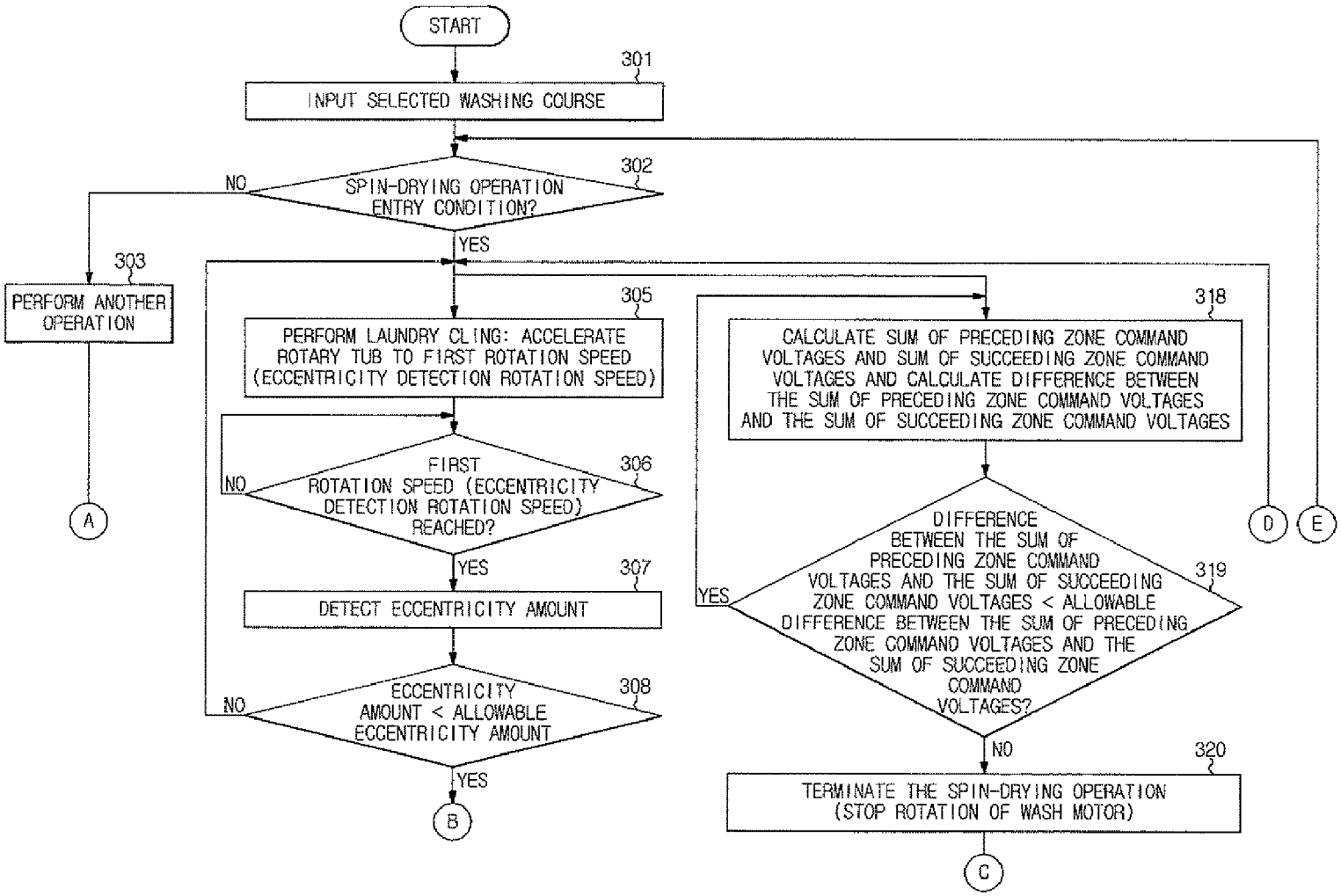
FIGS. 4 and 5 are flow charts illustrating a control process of the drum type washing machine having ball balancers according to the present invention.
Figure 5:
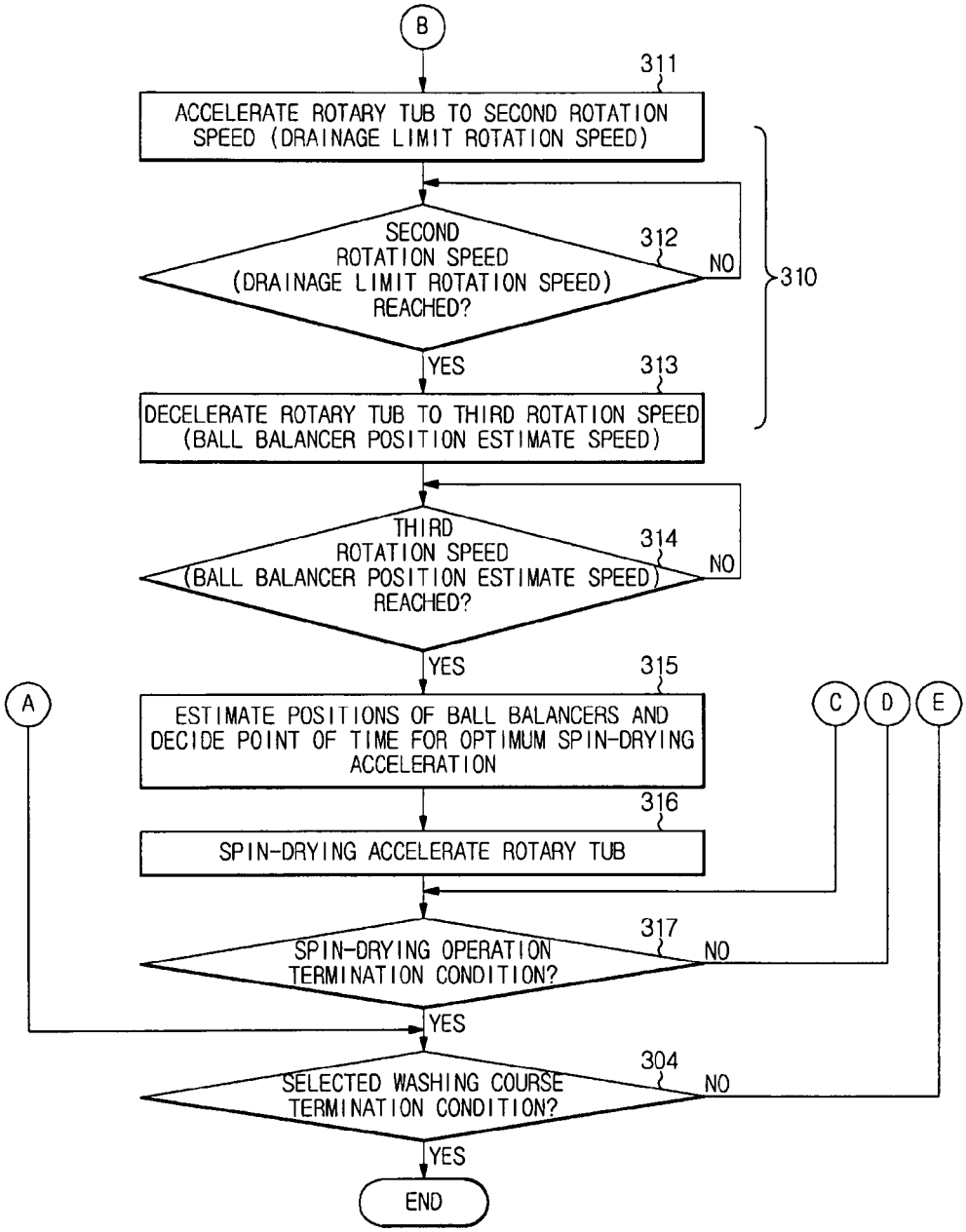

Referring to FIGS. 4 and 5, when a user selects a washing course through the input unit and the selected washing course is inputted from the input unit 210 (301), the controller 200 determines whether a spin-drying operation entry condition is satisfied (302). Here, the washing course is a combination of a washing operation, a rinsing operation, a spin-drying operation, and a drying operation.

When the spin-drying operation entry condition is not satisfied, the controller 200 controls another operation to be carried out (303) and determines whether a selected washing course termination condition is satisfied (304). When the selected washing course termination condition is not satisfied, the procedure returns to Step 302. When the selected washing course termination condition is satisfied, the procedure is terminated.

Figure 6:
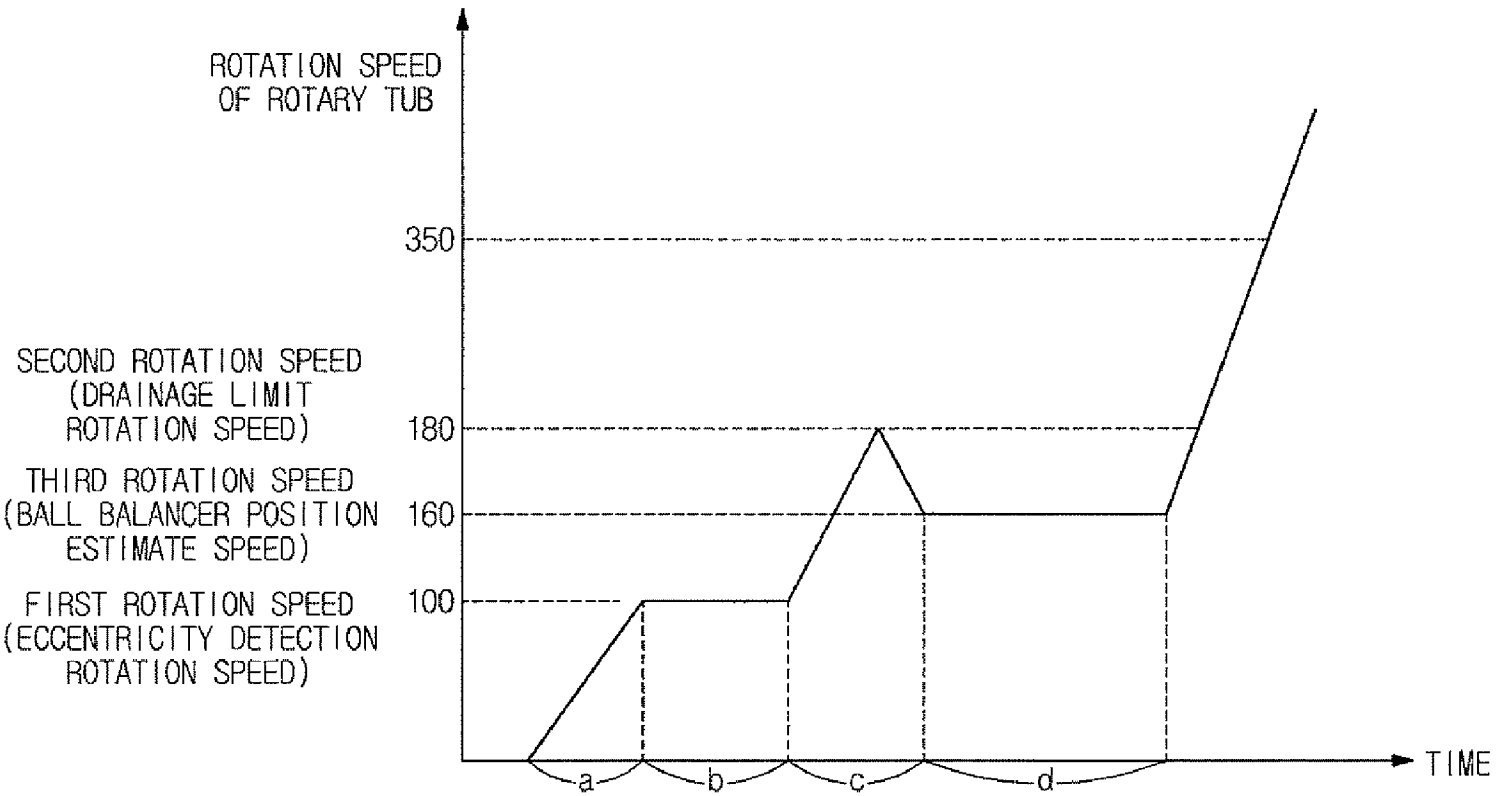
FIG. 6 is a graph illustrating the rotation speed of a rotary tub of the drum type washing machine having ball balancers according to the present invention according to a controlling method of the same.

On the other hand, when the spin-drying operation entry condition is satisfied, the controller 200 supplies a control signal to the wash motor drive unit 220 to perform laundry cling in which the rotary tub 30 is accelerated to a first rotation speed (eccentricity detection rotation speed), as in zone a of FIG. 6, such that laundry can be uniformly distributed on the inner wall of the rotary tub 30 (305). Here, the first rotation speed (eccentricity detection rotation speed) is a speed to detect the eccentricity amount of the laundry. As shown in the example of FIG. 6, the first rotation speed may be set to be approximately 100 rpm.

Subsequently, the controller 200 determines whether the rotation speed of the rotary tub 30 has reached the first rotation speed (eccentricity detection rotation speed) using the rotation speed of the wash motor 100 inputted from the wash motor rotation speed detection unit 230 (306).

When the rotation speed of the rotary tub 30 has not reached the first rotation speed (eccentricity detection rotation speed), the controller 200 controls the rotary tub 30 to be continuously accelerated. On the other hand, when the rotation speed of the rotary tub 30 has reached the first rotation speed (eccentricity detection rotation speed), the controller 200 controls the rotary tub 30 to be rotated at a constant speed for a predetermined period of time, as in zone b of FIG. 6, and detects the eccentricity amount of the laundry (307). Here, the eccentricity amount of the laundry may be detected by a general method of detecting eccentricity amount of the laundry using an angular speed deviation during one rotation of the rotary tub 30 for a predetermined period of time.

Subsequently, the controller 200 determines whether the detected eccentricity amount is less than an allowable eccentricity amount (308). When the detected eccentricity amount is not less than the allowable eccentricity amount, the procedure returns to Step 305. On the other hand, when the detected eccentricity amount is less than the allowable eccentricity amount, the controller 200 controls the rotary tub 30 to be accelerated to a second rotation speed (drainage limit rotation speed), as in zone c of FIG. 6, and performs a drainage process in which the rotary tub 30 is decelerated to a third rotation speed (ball balancer position estimate speed).

Specifically, the controller 200 supplies a control signal to the wash motor drive unit 220 such that the rotary tub 30 is accelerated to the second rotation speed (drainage limit rotation speed) (311). Here, the second rotation speed (drainage limit rotation speed) is a limit value less than a resonance range rotation speed of the rotary tub 30 and greater than the third rotation speed (ball balancer position estimate speed). Also, the second rotation speed (drainage limit rotation speed) is set in consideration of the mechanical properties of the drum type washing machine 1. As shown in FIG. 6, the second rotation speed (drainage limit rotation speed) may be set to be around 180 rpm. Subsequently, the controller 200 determines whether the rotation speed of the rotary tub 30 detected by the wash motor rotation speed detection unit 230 has reached the second rotation speed (drainage limit rotation speed) (312). When the rotation speed of the rotary tub 30 has not reached the second rotation speed (drainage limit rotation speed), the controller 200 supplies a control signal to the wash motor drive unit 220 such that the rotary tub 30 is continuously accelerated. When the rotation speed of the rotary tub 30 has reached the second rotation speed (drainage limit rotation speed), the controller 200 supplies a control signal to the wash motor drive unit 220 such that the rotary tub 30 is decelerated to the third rotation speed (ball balancer position estimate speed) (313). As a result, water rising along the outside of the rotary tub 30 falls to the bottom of the water tub 20 and is then drained.

Subsequently, the controller 200 determines whether the rotation speed of the rotary tub 30 detected by the wash motor rotation speed detection unit 230 has reached third rotation speed (ball balancer position estimate speed) (314). Here, the third rotation speed (ball balancer position estimate speed) is set to be a rotation speed at which the positions of the ball balancers 40 are not suddenly changed when the rotary tub 30 is spin-drying accelerated.

When the rotation speed of the rotary tub 30 has not reached third rotation speed (ball balancer position estimate speed), the controller 200 supplies a control signal to the wash motor drive unit 220 such that the rotary tub 30 is decelerated. On the other hand, when the rotation speed of the rotary tub 30 has reached third rotation speed (ball balancer position estimate speed), the controller 200 supplies a control signal to the wash motor drive unit 220, such that the rotary tub 30 is rotated at a constant speed, as in zone d of FIG. 6, estimates the positions of the ball balancers, and decides a point of time for spin-drying acceleration using the estimated positions of the ball balancers (315). Here, the method of estimating the positions of the ball balancers and the method of deciding the point of time for spin-drying acceleration are well known, and therefore, a detailed description thereof will not be given.

Subsequently, the controller 200 supplied a control signal to the wash motor drive unit 220 such that the rotary tub 30 is spin-drying accelerated at the point of time for spin-drying acceleration (316).

Subsequently, the controller 200 determines whether a spin-drying operation termination condition is satisfied (317). When the spin-drying operation termination condition is not satisfied, the controller 200 continues to determine whether the spin-drying operation termination condition is satisfied. On the other hand, when the spin-drying operation termination condition is satisfied, the procedure returns to Step 305.

While the controller 200 performs Step 305 to Step 316, the controller 200 also performs a control process to detect the generation of vibration from the rotary tub 30. In other words, the sum of preceding zone command voltages and the sum of succeeding zone command voltages are calculated, as previously described, and the difference between the sum of preceding zone command voltages and the sum of succeeding zone command voltages is calculated (318).

Subsequently, the controller 200 determines whether the calculated difference between the sum of preceding zone command voltages and the sum of succeeding zone command voltages is less than an allowable difference between the sum of preceding zone command voltages and the sum of succeeding zone command voltages (319). When the calculated difference between the sum of preceding zone command voltages and the sum of succeeding zone command voltages is less than the allowable difference between the sum of preceding zone command voltages and the sum of succeeding zone command voltages, the procedure returns to Step 318. On the other hand, when the calculated difference between the sum of preceding zone command voltages and the sum of succeeding zone command voltages is not less than the allowable difference between the sum of preceding zone command voltages and the sum of succeeding zone command voltages, the controller 200 terminates the spin-drying operation (320), and the procedure returns to Step 317.

As apparent from the above description, the present invention has the effect of reducing spin-drying time of the drum type washing machine having ball balancers.

Also, the present invention has the effect of detecting the generation of vibration from the rotary tub even when the rotary tub is not accelerated. Consequently, the present invention has the effect of protecting the drum type washing machine having ball balancers from breakage.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A controlling method of a drum type washing machine having a rotary tub to receive laundry and ball balancers installed on the rotary tub to maintain a dynamic balance, the control method comprising:

accelerating the rotary tub to a first rotation speed configured to detect eccentricity amount of laundry, when a spin-drying operation is performed;

maintaining the rotation speed of the rotary tub at the first rotation speed for a predetermined period of time;

detecting the eccentricity amount of the laundry, when the rotation speed of the rotary tub reaches the first rotation speed;

accelerating the rotary tub to a second rotation speed larger than the first rotation speed, configured to perform a drainage process when the detected eccentricity amount is less than a predetermined eccentricity amount;

when the detected eccentricity amount is not less than the predetermined eccentricity amount, accelerating the rotary tub to the first rotation speed, maintaining the rotation speed of the rotary tub at the first rotation speed for the predetermined period of time, and detecting the eccentricity amount of the laundry, when the rotation speed of the rotary tub reaches the first rotation speed;

decelerating the rotary tub to a third rotation speed configured to estimate positions of balls, when the rotation speed of the rotary tub reaches to the second rotation speed;

maintaining the rotation speed of the rotary tub at the third rotation speed for a predetermined period of time such that the balls move to a balancing position to estimate the positions of the balls when the rotation speed of the rotary tub reaches to the third rotation speed; and determining a point of time for spin-drying acceleration using the estimated positions of the balls;

accelerating the rotary tub to a rotation speed at the determined point of time for the spin-drying acceleration, wherein the third rotation speed is larger than the first rotation speed that is maintained to detect the eccentricity amount of the laundry for the predetermined period of time.

2. The controlling method according to claim 1, wherein the second rotation speed is less than a resonance range rotation speed of the rotary tub.

3. The controlling method according to claim 1, further comprising:

detecting a vibration of the rotary tub based on a command voltage applied to the wash motor.

4. The controlling method according to claim 3, wherein detecting the vibration of the rotary tub comprises calculating the sum of preceding zone command voltages, generated at a plurality of points of time in a preceding zone, and the sum of succeeding zone command voltages generated at a plurality of points of time in a succeeding zone, the preceding zone being before a succeeding zone, to calculate the difference between the sum of preceding zone command voltages and the sum of succeeding zone command voltages, and, when the calculated difference between the sum of preceding zone command voltages and the sum of succeeding zone command voltages is not less than a predetermined difference between the sum of preceding zone command voltages and the sum of succeeding zone command voltages, detecting that vibration from the rotary tub has been generated.

5. The controlling method according to claim 1, wherein the first rotation speed is approximately 100 rpm.

6. The controlling method according to claim 1, wherein the second rotation speed is approximately 180 rpm.

7. The controlling method according to claim 5, wherein the second rotation speed is approximately 180 rpm.

8. The controlling method according to claim 1, wherein the third rotation speed is approximately 160 rpm.

9. The controlling method according to claim 4, wherein the succeeding zone is a zone from 2 seconds ago to present time, and the preceding zone is a zone between 4 seconds ago to 2 seconds ago from the present time.

10. The controlling method according to claim 4, wherein the detecting the vibration is performed throughout the spin-drying operation so that when the calculated difference between the sum of preceding zone command voltages and the sum of succeeding zone command voltages is not less than a predetermined difference between the sum of preceding zone command voltages and the sum of succeeding zone command voltages, the spin-drying operation is terminated by stopping the rotation of the wash motor.

11. The controlling method according to claim 1, wherein the controlling method is performed before the rotation speed of the rotary tub reaches to 350 rpm.

* * * * *